United States Patent [19]

Wolze

[11] 4,108,140

[45] Aug. 22, 1978

[54] COFFEE POT HOLDER FOR RECREATIONAL VEHICLE STOVE AND THE LIKE

[76] Inventor: Martin H. Wolze, 3007 Hermosa Ave., La Crescenta, Calif. 91214

[21] Appl. No.: 747,201

[22] Filed: Dec. 3, 1976

[51] Int. Cl.[2] ..... F24C 15/10

[52] U.S. Cl. ..... 126/24; 126/42

[58] Field of Search ..... 126/24, 42, 218, 215, 126/211; 220/85 H; 248/311, 310

[56] References Cited

U.S. PATENT DOCUMENTS 3,960,134 6/1976 Scott ..... 126/24

*Primary Examiner*—Edward G. Favors

*Attorney, Agent, or Firm*—John E. Wagner

[57] ABSTRACT

A simple, unitary flexible sheet member designed to be removably secured to the burner region of a stove to prevent dislodgment of a coffee pot or cooking pot. The holder is fabricated from sheet material including a side wall portion and a number of depending legs, each of which terminate in a foot part. The holder is deformable to form generally into a circular shape and is spring action tending to flatten which brings the foot portions into engagement with the lip of the burner opening into the top of the stove. The spring action of the body holds the foot portions into engagement despite movement of the stove, as is common in a recreational vehicle, and the device is automatically adjusted to the size of the burner opening.

2 Claims, 4 Drawing Figures

COFFEE POT HOLDER FOR RECREATIONAL VEHICLE STOVE AND THE LIKE

BACKGROUND OF THE INVENTION

One of the perennial problems of recreational vehicles is that of retaining cooking pots, particularly coffee pots, on the stove top when the vehicle is in transit. It is often desirable while moving to provide hot coffee to the driver and passengers, and in many recreational vehicles, the operation of the stove while in transit is possible. One obvious and yet to be solved problem is that of moving and falling of a coffee pot or cooking vessel due to movement or abrupt stopping of the recreational vehicle. Apart from the operation of the stove while moving, it is desirable to allow a coffee pot to stay on the stove top when moving whether it is being heated or not. It is undesirable to have to stow away all appliances at all times for all movement, and this is particularly true of the ever present coffee pot. The problem of maintaining cooking pots in place on a moving stove has long been a problem. In the case of boats, it has been common to gimbal the stove whereby the cooking surface remains reasonably horizontal despite tacking and angular movement of the vessel laterally. Also, it has been customary in marine applications to put a lip around the edge of a table and sometimes a stove to prevent dishes and utensils from falling off. In the case of the stove, such a railing is inadequate since it only serves to hold a coffee pot or utensil which has already moved a significant distance off of the burner, and may in fact tend to aid in tipping the pot as it goes over the side. Other types of holders making contact with the vessel or coffee pot tend to conduct heat away and therefore reduce the efficiency of the cooking process.

BRIEF DESCRIPTION OF THE INVENTION

With the foregoing state of the art in mind, it is the general object of this invention to provide an improved utensil port holder for stove tops.

Another object is to provide a utensil and pot holder which is automatically adjustable to the dimensions of the stove burner assembly.

Another object is to provide a device of this character which is ultimate in simplicity, low in cost and easily cleaned and stored.

Another object of this invention is to provide a device of the type which does not interfere with the stove grid and requires no tools for attachment and no modification of the stove, and which may be removed in a matter of seconds.

Still another object of this invention is to provide a pot holder which does not interfere with the cooking process and in fact aids in the efficiency of operation of the stove.

These objects are all accomplished in a pot holder comprising a single planar sheet-like member of resilient sheet material including a wall portion having a number of depending finger portions extending from one side thereof. The finger portions each end in a hook so that the device, when manually curved into a generally circular or tubular shape, presents the hooks extending outward and in a position whereby they may engage the lip of the burner of the stove.

BRIEF DESCRIPTION OF THE DRAWINGS

This invention may be more clearly understood from the following detailed description and by reference to the drawings in which.

DETAILED DESCRIPTION OF THE INVENTION

A cardinal rule for users of recreational vehicles, a constant reminder is: remove the coffee pot from the stove before starting. The safety of the occupants from hot coffee spills or protection from damage to the furnishings requires adherence to this rule. Any deceleration or acceleration of the vehicle causes the coffee pot to slide off the stove.

Figure 1:
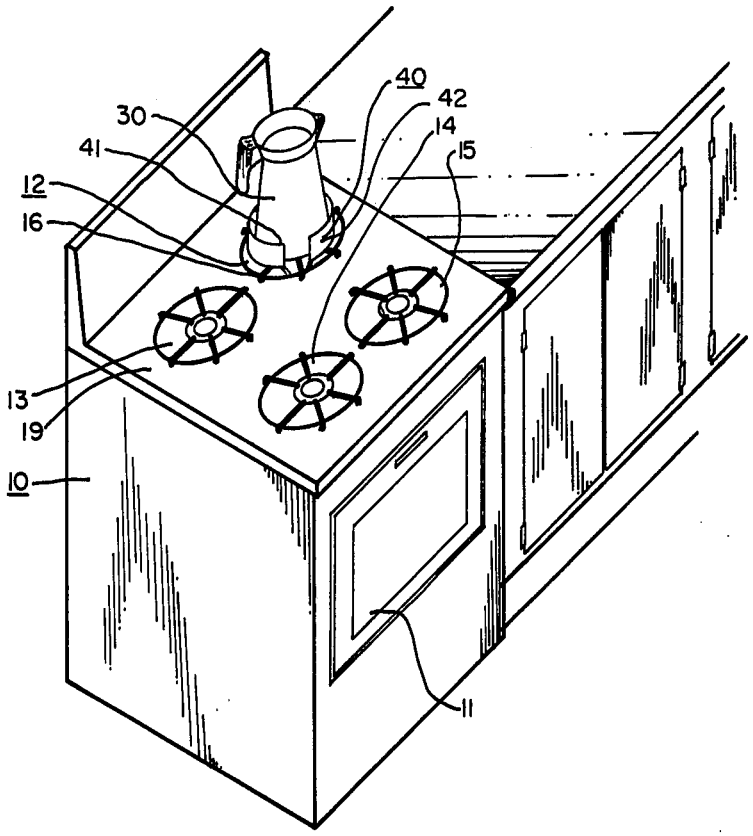
FIG. 1 is a perspective view of a recreational vehicle stove with this invention in place.

The rule is believed unnecessary when the device of this invention, which is effective to hold a coffee pot, is added to the stove as shown in FIG. 1. In FIG. 1, a conventional recreational vehicle stove 10 is shown, including an oven represented by the door 11 and a plurality of, for example 4 top burners such as 12–15. These burners, better seen in FIG. 2, each have a grid to support a utensil above a circular opening 20 through which the burner assembly 21 extends. This arrangement is almost identical to the conventional gas stove found in homes. The burner assembly 21 has a degree of clearance from the edge of the opening 20 in the top to allow for circulation of air, and to avoid the stove top 19 becoming unduly hot from the flame of the burner. It is in this circular cavity region 22 that laterally extending flames from the burner assembly 21 extend upward into contact with the under surface of the pot. Nearly all gaseous fuel stoves present this same general arrangement and appearance. Typically, a coffee pot 30 has a diameter approximating or slightly smaller than the outer diameter of the grid 16 on which it sits. The coffee pot 30 is usually larger in diameter than the opening 20. The coffee pot 30 usually contacts the grid 16 only at limited areas which take the form of radially extending bars in order that the grid itself does not obstruct the exposure to the burner of the pot bottom.

As shown in FIG. 1, the coffee pot 30 is located on burner 12 sitting on grid 16. Surrounding the lower portion of the pot is a retainer 40 of this invention with an opening 41 between the ends of the generally circular wall 42. The pot retainer 40 has clearance around the pot 30 and approximates in diameter the diameter of the burner grid 16. The wall portion 42 of the pot retainer 40 provides a generally tubular enclosure for the bottom quarter of the pot and is located approximately ½ inch from the outer periphery of the pot 30. It is so located that a pot which might begin sliding movement can travel only less than an inch before encountering the retainer 40 of nearly the same diameter. When a pot 30 has so moved, it still remains substantially on top of the burner without any significant loss in efficiency of heating.

Figure 2:
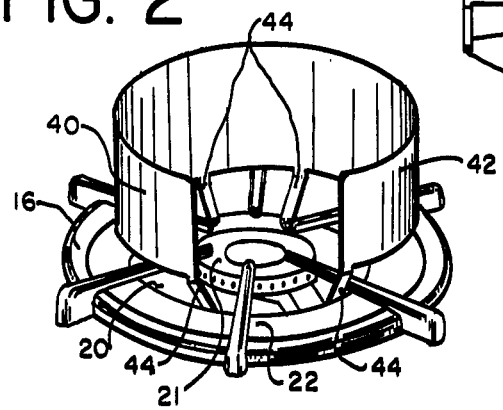
FIG. 2 is an enlarged perspective view of the pot holder of this invention.
Figure 4:
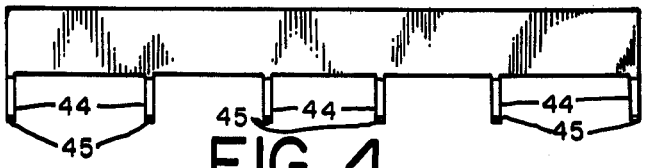
FIG. 4 is a side elevational view of this invention.
Figure 3:
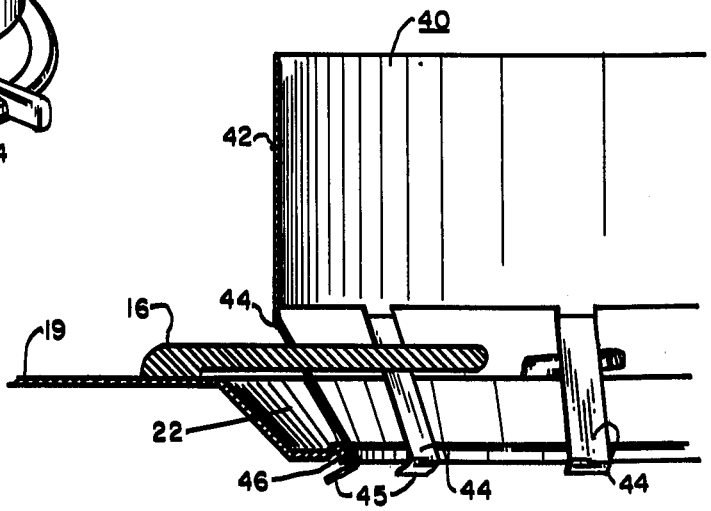
FIG. 3 is a vertical sectional view through the stove and pot holder assembly of FIG. 1 taken along lines 3—3 of FIG. 1.

The pot retainer may be seen in greater detail in FIGS. 2 and 3, where the pot has been removed. In these figures, the pot retainer 40 may be seen as including a number of depending legs 44, for example 6 in number. These legs 44 are formed integrally with the side wall 42 but are bent (inwardly) when in position on a stove burner. Each leg 44 includes an outward extending foot 45 which engages the lip 46 of the burner top 19. The feet 45 are urged outward against the lip 46 by the inherent resilient property of the retainer 40 tending to cause it to return to its normal flat wall 42 configuration as shown in FIG. 4. Any movement of a pot in any direction until it strikes the sidewall 42 results in direct tension loading on the legs 44, further engaging the foot 45 with the lip 46.

As may be seen in FIGS. 2 and 3, the legs 44 extend slightly above the level of the top of grid 16. Thus, the upper ends of the legs 44 present slight upward extending ramps to the coffee pot or utensil which tends to recenter any pot which has moved slightly off center. This upper extension of the legs 44 further provides adequate clearance with grids 16 of different stoves. The regions 50 between the legs 44 provides an egress for some of the heated air and combustion products from the burner region while the wall 42 confines the flow of much of the heated gaseous material to the region upward along the side of the pot, thus adding additional energy input to the pot and conserving fuel. The wall 42 does not extend so high as to interfere with the handle of the pot or utensil which may extend outward above the wall 42 or, if necessary, out through the opening 41.

The retainer 40 of this invention may be stored flat as shown in FIG. 4 and installed on a burner merely by grasping the wall 42 with both hands and curving it into a tube with the legs 44 extending inward. The assembly is next lowered with the legs 44 and feet 45 extending into the opening 20 and released. The wall 42 will attempt to flatten out and in the process the legs 44 and feet 45 will engage the rim 46 regardless of the diameter of the opening 20. Thereafter, the retainer will remain in place and ready for use.

Although many metals may be used for this invention, I have found that 22–26 gage tempered aluminum ASTM 6061 T6 is preferred. A length of 16–18 inches has been found to be adequate to fit all stoves encountered. A wall height of 2½ inches has been found to be sufficient to provide effective protection from pot tipping.

I have found that the wall height need be at least 2 inches in order to be most effective in retaining a pot and in confining the heat to the pot.

As a second choice material, stainless steel of ASTM 25–27 gage may be used.

I have found that for most coffee pots, leg lengths of 2–2½ inches is preferred. I have also found that by merely producing this invention with longer legs, it can be made to hold pots or pans as well. The legs can be as long as 5–7 inches and will hold larger pots and frying pans in place.

The above described embodiments of this invention are merely descriptive of its principles and are not to be considered limiting. The scope of this invention instead shall be determined from the scope of the following claims including their equivalents.

What is claimed is:

1. A pot retainer for cooking stoves comprising an elongated flexible member of sheet metal including a wall portion which is bendable to define a generally tubular shape;

a plurality of leg members extending laterally from said wall portion whereby said leg members define a plurality of outward extending feet for engagement with the periphery of a burner opening in a cooking stove to retain said member in a generally tubular shape and adjacent to said opening;

the spring characteristic of said flexible member tending to return the member to a generally planar position to mechanically bias said feet radially outward against the periphery of said opening;

wherein said leg members are angled inward when said member is in a generally tubular shape, and said feet are angled outward to define a region for locking against the periphery of said burner opening.

2. A pot retainer for cooking stoves comprising an elongated flexible member of sheet metal including a wall portion which is bendable to define a generally tubular shape;

a plurality of leg members extending laterally from said wall portion whereby said leg members define a plurality of outward extending feet for engagement periphery of a burner opening in a cooking stove to retain said member in a generally tubular shape and adjacent to said opening;

the spring characteristic of said flexible member tending to return the member to a generally planar position to mechanically bias said feet radially outward against the periphery of said opening;

said retainer for use in combination with a stove having a burner opening and a pot supporting grid above the burner opening wherein said leg members have a length sufficient to extend through said grid and to hold said member in position over the burner opening and grid with clearance between the edge of said wall portion and said opening and grid.

* * * * *